US011680578B1

(12) United States Patent
Jimenez

(10) Patent No.: US 11,680,578 B1
(45) Date of Patent: Jun. 20, 2023

(54) IMPELLER FOR DISC PUMP

(71) Applicant: MXQ, LLC, Houston, TX (US)

(72) Inventor: Juan Jimenez, Houston, TX (US)

( * ) Notice: Subject to any disclaimer, the term of this patent is extended or adjusted under 35 U.S.C. 154(b) by 0 days.

(21) Appl. No.: 17/726,314

(22) Filed: Apr. 21, 2022

(51) Int. Cl.
*F04D 29/22* (2006.01)
*F04D 7/04* (2006.01)

(52) U.S. Cl.
CPC ..... *F04D 29/2216* (2013.01); *F04D 7/04* (2013.01)

(58) Field of Classification Search
CPC ..... F04D 29/2216
See application file for complete search history.

(56) References Cited

U.S. PATENT DOCUMENTS

| | | | | |
|---|---|---|---|---|
| 1,013,248 | A | 1/1912 | Wilkinson | |
| 4,768,920 | A * | 9/1988 | Gurth | A01K 79/00 415/227 |
| 4,773,819 | A | 9/1988 | Gurth | |
| 4,940,385 | A * | 7/1990 | Gurth | F04D 5/001 415/206 |
| 5,355,993 | A | 10/1994 | Hay | |
| 5,385,443 | A | 1/1995 | Dufour | |
| 5,551,553 | A | 9/1996 | Hay | |
| 7,044,288 | B2 | 5/2006 | Barer | |
| 8,210,816 | B2 | 7/2012 | Geldenhuys | |
| 2007/0258824 | A1 | 11/2007 | Pacello | |
| 2008/0213093 | A1 | 9/2008 | Guelich | |
| 2012/0014779 | A1 | 1/2012 | Gillim | |
| 2015/0308446 | A1 | 10/2015 | Koivikko | |

FOREIGN PATENT DOCUMENTS

| | | | |
|---|---|---|---|
| WO | 2014073976 | A1 | 5/2014 |

* cited by examiner

*Primary Examiner* — Sabbir Hasan
(74) *Attorney, Agent, or Firm* — Egbert, McDaniel & Swartz, PLLC

(57) ABSTRACT

An impeller for a disc pump has a drive disc with a connector for joining to a shaft of the disc pump, a driven disc affixed to the drive disc so as to define a space therebetween, and a plurality of wing vanes formed in the face of at least one of the drive disc and the driven disc. The drive disc has a face facing a face of the driven disc. The drive disc extends in generally parallel planar relationship to the driven disc. The plurality of wing vanes radiate across the face toward an outer diameter of one of the drive disc and the driven disc. Each of the plurality of wing vanes has a portion extending outwardly beyond the outer diameter of the drive disc and the driven disc.

13 Claims, 6 Drawing Sheets

IMPELLER FOR DISC PUMP

CROSS-REFERENCE TO RELATED APPLICATIONS

Not applicable.

BACKGROUND OF THE INVENTION

1. Field of the Invention

The present invention relates to disc pumps. More particularly, the present invention relates to the impellers for moving fluids associated with such disc pumps. More particularly, the present invention relates to a vane structure as used on the surfaces of the impeller.

2. Description of Related Art Including Information Disclosed Under 37 CFR 1.97 and 37 CFR 1.98

Boundary layer or bladeless turbines, pumps, and other related turbo-machinery have been known for one hundred years or more. Nikola Tesla obtained a patent (U.S. Pat. No. 1,061,142) for such a device in 1913. The Tesla patent disclosed a multiple-disc pump that utilized rotating flat discs with no blades, vanes, or propellers. Such pumps have been referred to as disc pumps, boundary layer pumps, or bladeless pumps.

In U.S. Pat. No. 1,061,206, Tesla disclosed a fluid-driven boundary layer or bladeless turbine which may be utilized as a prime mover in various applications. The Tesla bladeless turbine, when used as the driving force for a hydro-electric generator, could transform the kinetic energy of a flowing fluid into electrical energy. In U.S. Pat. No. 1,329,559, Tesla disclosed another application of the bladeless turbine, this time in an internal combustion engine. The Tesla patent show early disclosures of rotational machines using bladeless or boundary layer discs.

Unlike more traditional centrifugal pumps which utilize vanes, blades, augers, buckets, pistons, gears, diaphragms, and the like, boundary layer pumps, such as those described by Tesla, typically utilize multiple rotating parallel discs. Disc pumps, as these machines are sometimes called, utilize the fluid properties of adhesion and viscosity. These fluid properties combine to create an interaction between the fluid and the rotating flat discs that allow the transfer of mechanical energy from the rotating discs to the fluid.

Boundary layer or disc pumps (both names are used in the industry and both are used interchangeably) have been reported to have advantages over traditional pumps, especially when utilized for pumping fluids other than cool, clean, homogenous liquids. The vanes, buckets, or the like, of traditional pumps wear and lose effectiveness due to normal friction and/or impingement with particles (such as sand or other abrasives). However, the flat surfaces of boundary layer pumps are much less susceptible to wear. It is not unusual for such a pump to show little or no wear even after extended use.

Disc pumps have been found to be especially effective for pumping high viscosity fluids wherein the a efficiency of such pumps may actually increase as the fluid viscosity increases. Disc pumps have also been reported to be more cost-effective in terms of reliability and decreased downtime for pumping problematic multiphase fluids, which may comprise gases, liquids, and/or solid materials. Disc pumps have been found to greatly reduce maintenance costs and downtime when used to replace more traditional pumps in these demanding settings.

Traditional centrifugal pumps have vanes which are designed to shear and sling the liquid in order to impart centrifugal force. These typical centrifugal pumps have problems with cavitation, clogging, binding, and high wear when used for pumping slurries, liquids with solids, high viscosity fluids, and fluids with entrained air or gas. Because of the shortcomings, centrifugal pumps are available with modified impellers which have no vanes or have fractional vanes to avoid complete impingement on the liquid. These are also known as disc pumps. Disc pumps are commonly chosen to transport liquids with slurries having a great amount of solids, high viscosity, and slurries with entrained air or gas. They are also used to pumps the shear-sensitive liquids and to prevent emulsification or degradation of the liquid.

A disc pump is comprised of an outer housing with an inner cylindrical rotor chamber having an inlet at one end and an outlet at its outer periphery. A rotor assembly in the chamber is composed of at least two parallel spaced discs disposed co-axially in the chamber and connected together for rotation about the center axis. The inner opposing faces of the discs are spaced a pre-determined distance apart and a series of raised ribs or vanes are provided on at least one of the opposing faces when the vane height is less than the disc spacing. The first disc is known as the drive disc and is attached to the pump shaft. The other discs are attached to the drive disc via pins or posts. The drive disc is solid. The additional disc has a hole in the center to allow the liquid to enter.

The inherent design of a disc pup removes typical vanes from the impeller and uses friction dragged or surface tension to propel the liquid. This design creates slippage and is very inefficient. Some disc pump designs have incorporated rectangular ribs to make the discs more efficient. These ribs start at the center of the disc and extend to the outer diameter of the disc. Despite these modifications, these improvements are still highly inefficient because of dead zones created by vortices on the back of the rectangular ribs and lack of surface area to propel the liquid in a laminar manner.

FIGS. 1-3 show a particular structure of the rotary disc pump. FIGS. 1-3 are described in U.S. Pat. No. 4,940,385, issued on Jul. 10, 1990 to M. I. Gurth. FIGS. 1 and 2 illustrate a rotary disc pump 10 for pumping various types of fluids, including relatively abrasive slurries or fluids having solid contents, highly viscous fluids, and fluids having entrained gas contact. The pump basically comprises a housing 12 having an inner cylindrical rotor chamber 14 in which a rotor assembly 16 for pumping fluid through the pump is rotatably mounted. Chamber 14 has an inlet 18 at one end and an outlet 20 extending generally tangentially from the outer periphery of the chamber.

The rotor assembly 16 is illustrated in FIGS. 2 and 3 and comprises a pair of parallel, spaced discs 22, 24 disposed coaxially in the rotor chamber 14. The first disc 22 at the inlet of the chamber has a central opening 26 aligned with inlet 18 for allowing fluid to flow from the inlet into the spacing between the discs. The first disc is connected to the second or drive disc 24 via a plurality of pins or connectors 28 spaced around and closely adjacent to the axis of the discs. The drive disc 24 is connected on its outer face 30 to a suitable driveshaft 32, which is connected to a motor (not shown) for driving the assembly.

Each disc 22, 24 has a plurality of generally radially extending vanes or ribs 34, 35 on each of its faces, which extend from the outer periphery of the disc towards the center. The ribs 34, 35 have bars of generally rectangular cross-section welded to the opposite faces of each disc. Eight vanes are provided on each disc face at equal intervals. The vanes 34, 35 on the opposing disc faces are in alignment, as shown in FIG. 3. The discs 22, 24 are spaced a predetermined distance apart, depending on the characteristics of the fluid to be pumped. The combined height of the opposing vanes on the interfaces of the discs is less than the disc spacing so as to leave a large gap between the opposing inner vanes (as shown in FIG. 2). This gap depends on the characteristics of the fluid being pumped. The vanes or ribs are straight and of uniform width. The vanes extend up to or close to the center opening 26 in disc 22 and are of equivalent or slightly greater length on disc 24. The inner ends 38 of the vanes are pointed or tapered as illustrated to provide more clearance for fluid to pass between the vanes where they converge together towards the center of each disc.

In operation, fluid enters the pump through the inlet conduit and proceeds to the spacing between the opposing disc faces. As the discs rotate, the fluid will proceed radially outwardly to the outer portions of the disc by a combination of friction and pressure gradients, along with viscous drag created by the rotating discs enhanced by the action of the vanes. This adds to the profile or form passing through the fluid and thus increases the form drag. The fluid is then discharged through the outlet which is located on an area of the peripheral wall of the chamber between the two discs.

In the past, various patents and patent application publications have issued with respect to such centrifugal or disc pumps. For example, U.S. Pat. No. 1,013,248, issued on Jan. 2, 1912, describes a centrifugal pump which is the combination of a pump casing, a rotatable shaft mounted therein, and a series of friction or impeller discs carried by the shaft. Curved vanes are secured between the impeller discs near the periphery thereof. The vanes overlap each other, but leave a gradually narrowing space from the center outwardly. The impeller discs have interior rounded edges and a means for fastening the impeller structure together.

U.S. Pat. No. 4,773,819, issued on Sep. 27, 1988 to M. I. Gurth, describes a rotary disc slurry pump that includes a rotary pump having a plain disc impeller disposed in a cylindrical chamber of a housing with an inlet coaxial of the impeller into the housing and a substantially square outlet from the periphery of the chamber. A rotor is arranged to provide a substantially unobstructed passage between the inlet and the outlet of the pump.

U.S. Pat. No. 5,355,993, issued on Oct. 18, 1994 to A. G. Hay, teaches an apparatus for transporting and metering particulate material. This apparatus includes a transport duct having an inlet, an outlet, and at least one moving surface located therebetween and having a downstream facing drive surface. A motive device for moving the moving surface between the inlet and the outlet is provided. The particulate matter is compacted sufficiently to cause the formation of a bridge composed of substantially interlocking particulates spanning the width of the transport duct. The bridging of the particulates causes the particulates to become semi-hydrostatic in nature such that the force exerted by the downstream facing drive surface upon the particulates within the transport duct drives the entire mass of material through the transport duct toward the outlet.

U.S. Pat. No. 5,385,443, issued on Jan. 31, 1995 to R. Dufour, shows a centrifugal liquid pump of the rotary disc type that incorporates a gas injection assembly. The gas injection assembly allows up to 15% per volume of the gas to be mixed with the pumped liquid. The gas injection is achieved with a gas feed pipe that enters the pump to its axial inlet with a plurality of gas injectors that project from the gas feed pipe radially within the impeller.

U.S. Pat. No. 5,551,553, issued on Sep. 3, 1996 to A. G. Hay, discloses an apparatus for transporting particulate material. A housing is provided and includes a wall defining an inlet and a wall defining an outlet space downstream from the outlet. A duct is enclosed in the housing between the inlet and the outlet. The duct is formed between first and second substantially opposed drive walls movable relative to the housing from the inlet toward the outlet and at least one arcuate wall extending between the inlet and the outlet. The drive walls have a greater surface area for contacting the solid material than the arcuate walls. The drive walls rotate relative to an axis. An assembly is provided for positioning the second drive wall in the housing for rotation in a plane at an angle relative to the axis such that the distance between the first and second drive walls adjacent to the inlet is greater than the distance downstream from the inlet when the drive walls are moving.

U.S. Pat. No. 7,044,288, issued on May 16, 2006 to Barer et al., shows a bulk material pump having a housing and a rotatable drive rotor for transporting material from an inlet to an outlet of the housing. The drive rotor has a hub. Drive discs extend away from the hub toward an inner wall of a housing. The distance between the circumferential edges of the drive discs and the inner wall of the housing increases from the inlet to the outlet in the direction of rotation of the drive rotor. A low-friction brush seal is disposed on the periphery of the drive discs so as to seal the area between the periphery of the drive discs and the inner wall. A material scraper having a flexible tip is mounted in the housing and extends into the drive rotor between the drive discs.

U.S. Pat. No. 8,210,816, issued on Jul. 3, 2012 to S. Geldenhuys, teaches an impeller for a centrifugal pump. The centrifugal pump includes a pump casing within which an impeller is mounted for rotation, in a cantilever fashion, on a shaft. The casing has an axial inlet and a peripheral volute around the impeller leading to an outlet. The impeller has axially spaced annular sides with radially outwardly arranged, rearwardly curved, vanes between the sides. A clearing that corresponds to sides of the casing is located outwardly of the sides. Auxiliary vanes are provided to generate a pressure gradient to prevent or counteract leakage of working fluid. Leading faces of the auxiliary vanes slope relative to and perpendicular to the sides. The leading edges are at an obtuse angle to the sides.

U.S. Patent Application Publication No. 2007/0258824, published on Nov. 8, 2007 to Pacello et al., provides a rotor for viscous or abrasive fluids. This rotor comprises a drive disc and a plurality of driven discs in a stack. The stacked discs are in spaced relationship along a rotational axis so as to form inter-disc spaces. A centrally-positioned aperture is provided in each of the driven discs so as to open into the inter-disc spaces. A hub is connected to the drive disc for communication with a driveshaft. There is a plurality of axial vanes within the apertures and attached to the discs whereby rotation of the rotor causes the fluids to be drawn into the apertures and then into the inter-disc spaces.

U.S. Patent Application Publication No. 2008/0213093, published on Sep. 4, 2008 to J. Guelich, discloses an impeller for pumps in which a rotary wheel includes an intermediate wall at which one or more vanes are provided on each side thereof. Passage openings are formed in the intermediate wall in order to distribute a desired pump flow into the vanes on both sides of the intermediate wall.

U.S. Patent Application Publication No. 2012/0014779, published on Jan. 16, 2012 to C. D. Gillim, teaches a disc pump having one or more rotating discs within a housing. The discs have a plurality of relatively small surface perturbations covering at least one-half of one side of their surface. The perturbations may be recessed or raised. In operation, a boundary layer is formed near the surface of the rotating discs. The fluid within the pump flows in a circular and outward direction, thus moving the fluid from a central coaxial inlet to an outlet located at the peripheral wall of the housing. The surface perturbations produce turbulence within the boundary layer during operation.

U.S. Patent Application Publication No. 2015/0308446, published on Oct. 29, 2015 to Koivikko et al., shows an impeller for a centrifugal pump in which the impeller includes a front shroud, a rear shroud, and one or more working vanes therebetween. The front shroud has a front surface opposite to the face having the working vanes. The rear shroud has a rear face opposite to the face having the working vanes. The front shroud has an outer circumference of the plurality of front pump-out vanes attached to the front face of the front shroud. The rear shroud has a plurality of rear pump-out vanes attached to the rear face of the rear shroud.

International Publication No. WO2014/073976, published on May 15, 2014 to S. Ree, discloses an impeller for a centrifugal pump for pumping drill fluid containing cuttings. The impeller has a rear side wall and a front side wall. Arranged between the rear side wall and the front side wall is a number of vanes with an outer edge and a vane with in the axial direction. At least one of the periphery of the rear side wall or the periphery of the front side wall projects by radial distance beyond the outer edge of the vanes. The radial distance is at least 0.5 times the vane width.

It is object of the present invention to provide an impeller for a disc pump that avoids vortices.

It is another object of the present invention to provide an impeller for a disc pump which pumps liquids with slurries, solids, high-viscosity liquids and liquids entrained with air or gas.

It is another object of the present invention to provide an impeller for a disc pump that has improved efficiency.

It is another object of the present invention to provide an impeller for a disc pump that has a reduced carbon footprint.

It is another object of the present invention to provide an impeller for a disc pump that can pump shear-sensitive liquids.

It is another object of the present invention to provide an impeller for a disc pump that prevents emulsification or degradation of the liquid.

It is another object of the present invention to provide an impeller for a disc pump that minimizes eddy currents on the back of the vane.

It is a further object of the present invention to provide an impeller for a disc pump that minimizes dead zones and swirls.

It is still a further object of the present invention to provide an impeller for a disc pump that has a greater propelling surface area.

These and other objects and advantages of the present invention will become apparent from a reading of the attached specification and appended claims.

BRIEF SUMMARY OF THE INVENTION

The present invention is an impeller for a disc pump having a drive disc with a connector for joining to a shaft of the disc pump, a driven disc affixed to the drive disc so as to define a space therebetween, and a plurality of wing vanes formed on the face of the at least one of the drive disc and the driven disc. The drive disc has a face facing a face of the driven disc. The drive disc extends in generally parallel planar relationship to the driven disc. The plurality of wing vanes radiate across the face of either the drive disc or the driven disc, or both, toward an outer diameter thereof. The plurality of wing vanes have a portion extending outwardly beyond the outer diameter of at least one of the drive disc and the driven disc.

Each of the plurality of wing vanes has a thickness that tapers so as to narrow across a width thereof. The thickness of each of the plurality of wing vanes is generally flush with the face of the drive disc or driven disc on one side of the wing vane. The surface of each of the plurality of wing vanes opposite the face is curved such that one end of the curved shape is flush with the face and an opposite end is spaced from the face. This curved shape is at a forward drive direction of the drive disc and the driven disc.

The portion of each of the plurality of wing vanes that extends outwardly beyond the outer diameter of the drive disc and/or the driven disc extends outwardly for no more than 20° of the outer diameter of the drive disc or the driven disc. The portion of each of the plurality of wing vanes that extends outwardly beyond the outer diameter of the drive disc and/or the driven disc has a jagged edge.

The drive disc is affixed to the driven disc by a plurality of posts extending transverse to the respective faces of the drive disc and the driven disc. The plurality of posts each are arranged between adjacent pairs of the plurality of wing vanes. Each of the plurality of posts has a circular cross-section in a plane parallel to the faces of the drive disc and the driven disc.

In an embodiment of the present invention, the plurality of wing vanes are formed on the faces of both the drive disc and the driven disc. The plurality of wing vanes on the drive disc correspond in location to the plurality of wing vanes on the driven disc. Each of the plurality of wing vanes has a forward edge. This forward edge has an arcuate shape.

In another embodiment of the present invention, at least some of the plurality of wing vanes have a winglet extending in generally transverse relationship therefrom. The winglet has an airfoil shape with a narrow thickness at one side and a wide thickness at an opposite side. The airfoil shape has a curved inner surface facing the drive disc and/or the driven disc. The airfoil shape has a curved outer surface and a curved inner surface. The drive disc and/or the driven disc has a scalloped outer diameter. The scalloping is located between adjacent pairs of the plurality of wing vanes.

In a further embodiment the present invention, the winglet affixes the drive disc to the driven disc. In particular, each of the drive disc and the driven disc has the plurality of wing vanes thereon. The plurality of wing vanes of the drive disc has the winglet affixed to a corresponding winglet of the plurality of wing vanes of the driven disc.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
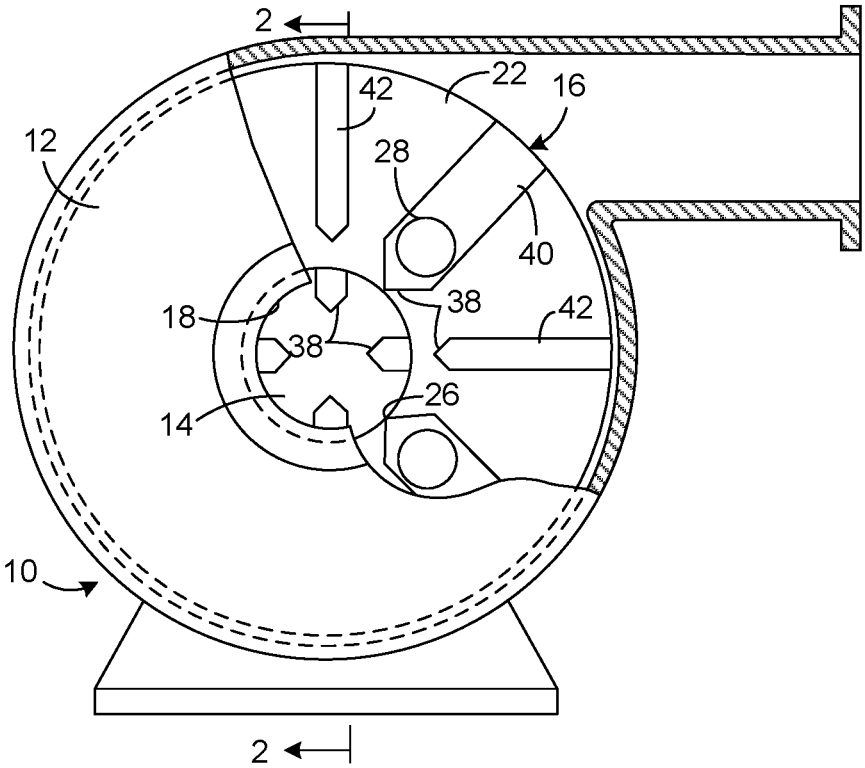
FIG. 1 PRIOR ART
FIG. 1 is a side cross-sectional view showing a disc pump of the prior art.
Figure 2:
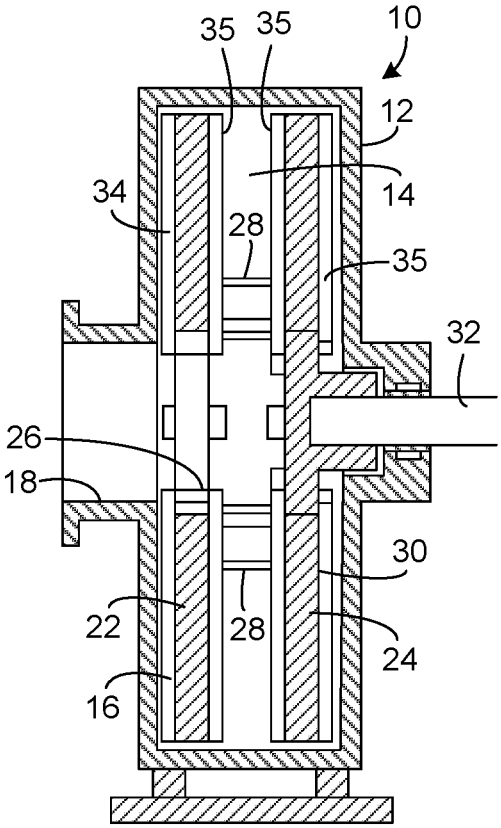
FIG. 2 PRIOR ART
FIG. 2 is a cross-sectional view taken across lines 2-2 of FIG. 1 of the disc pump of the prior art.
Figure 3:
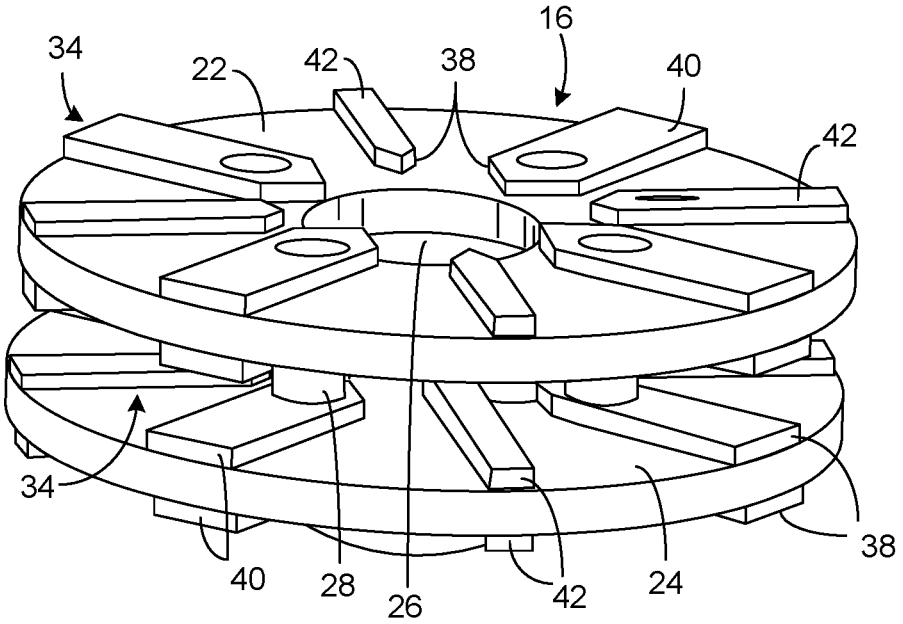
FIG. 3 PRIOR ART
FIG. 3 is an upper perspective view of the impeller as used in the disc pump of the prior art.
Figure 4:
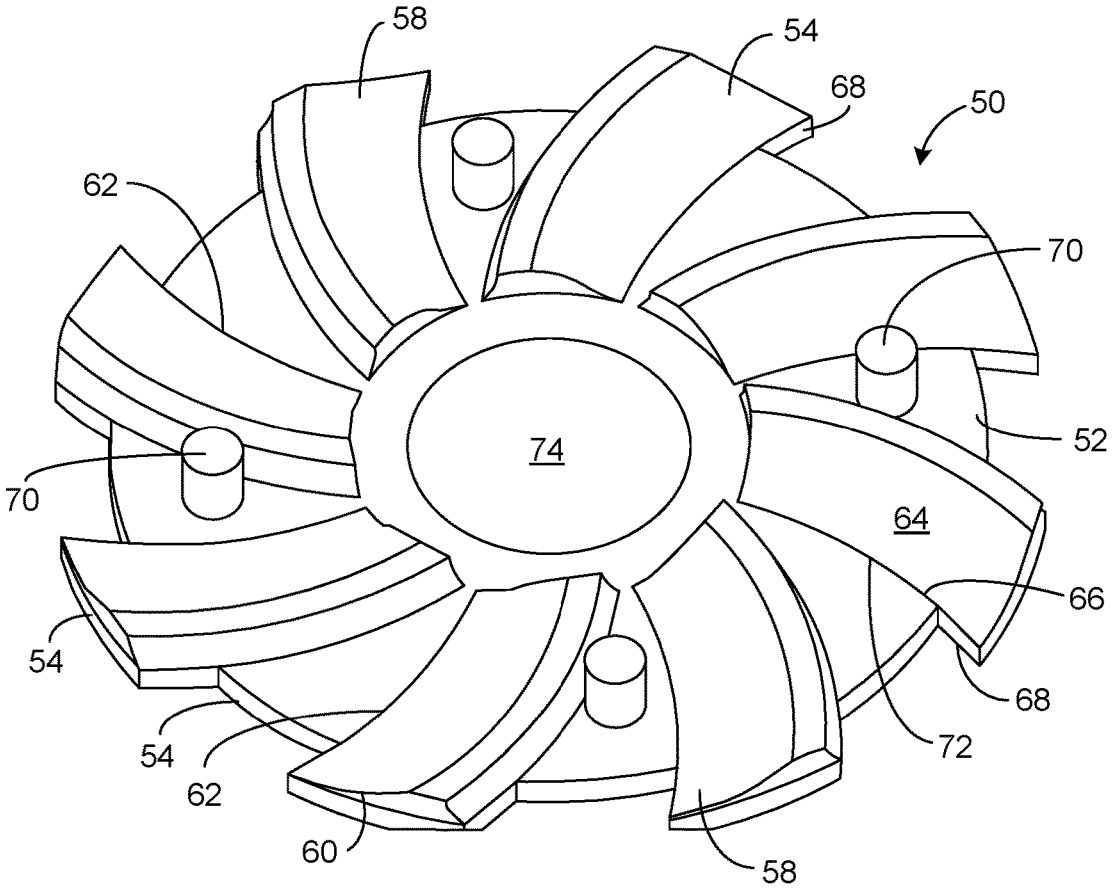
FIG. 4 is an isolated perspective view of one of the drive discs or driven discs in accordance with the present invention.

The present invention is an impeller for use in a disc pump, such as the type shown in FIGS. 1-3. FIG. 4 shows disc 50. Disc 50 can be either a drive or a driven disc of the impeller. If disc 50 is the driven disc, it can be a single driven disc or a plurality of driven discs arranged in spaced parallel planar relationship to each other. Disc 50 has a face 52 with a plurality of wing vanes 54 formed on face 52. The plurality of wing vanes 54 radiate across the face 52 toward an outer diameter 56 of the disc 50. Each of the plurality of wing vanes 54 has a portion 58 that extends outwardly beyond the outer diameter 56 of disc 50.

In FIG. 4, it can be seen that each of the plurality of wing vanes 54 has a thickness 60 that tapers so as to narrow across a width of the wing vanes 54. The thickness 60 is generally flush with the face 52 along side 62. The surface 64 of each of the plurality of wing vanes 54 that is opposite to the face 52 has a curved shape such that one end of the curved shape 66 is flush with the face 52 and an opposite end of the curved shape is spaced from the face 52. The side 62 of each of the wing vanes 54 is at a forward drive direction of the disc 50. The portion 58 of the wing vane 54 that extends outwardly beyond the outer diameter 56 of the disc 50 extends outwardly for no more than 20% of the outer diameter 56 of the disc 50. It can be seen that this portion 58 has a generally jagged edge 68.

As will be described hereinafter, the disc 50 can be affixed to either the drive disc or to the driven disc by a plurality ofposts 70 that extend outwardly generally transverse to the face 52 of disc 50. The plurality of posts 70 are arranged between adjacent pairs of the plurality of wing vanes 54. Each of the plurality of posts 70 has a generally circular cross-section in a plane parallel to the face 52 of the disc 50. Each of the plurality of wing vanes 54 has a forward edge 72 having a generally arcuate shape.

FIG. 4 shows, in particular, the drive disc of the present invention. As such, there is a connector 74 located at the center of the disc 50. Wing vanes 54 radiate outwardly from the connector 74. Each of the wing vanes 54 has a generally curved shape as it radiates outwardly from the connector 74. Connector 74 is adapted to connect the disc 50 to a shaft of a motor or pump.

Figure 5:
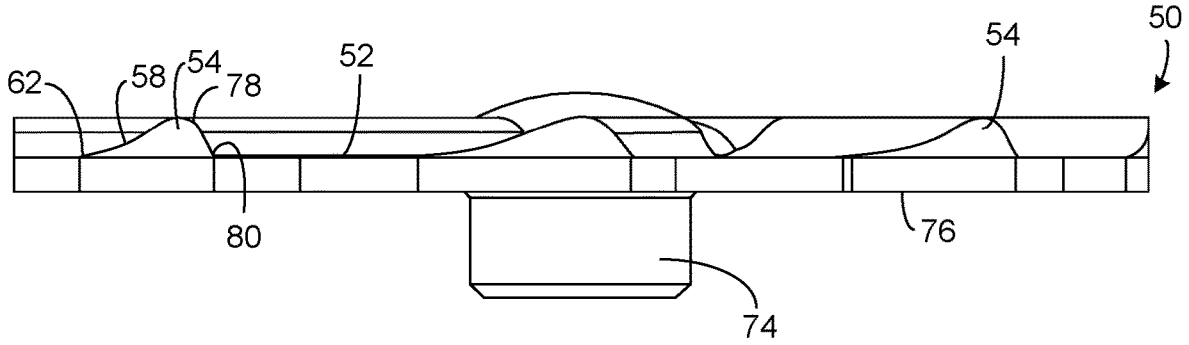
FIG. 5 is a side elevational view of one of the drive discs or driven discs of the present invention.

FIG. 5 is a side view of the disc 50. Disc 50 has the connector 74 extending below the underside 76 of disc 50. The wing vanes 54 are illustrated as extending upwardly from face 52. Face 52 is opposite to the rear surface 76. FIG. 5 shows, in particular, that the wing vane 54 has a curve 58 on one side and that the vane 54 increases in thickness from the side 62. At side 62, the thickness of the vane wing 54 is generally flush with the face 52 of the disc 50. The thickness at the highest point 78 of wing vane 54 is greatest adjacent to the side 80. It can be seen that the wing vane 54 diminishes in thickness at a relatively sharp angle from the highest point 78 to the side 80. Each of the wing vanes 54 has a similar configuration.

Figure 6:
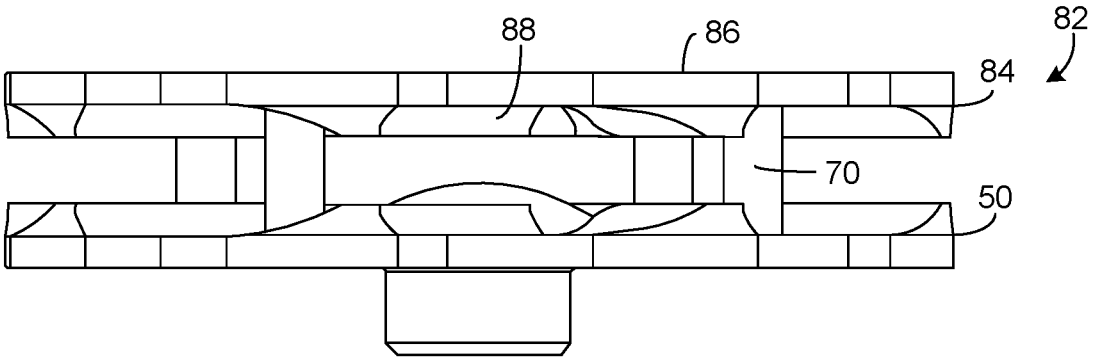
FIG. 6 is a side view showing the impeller made up of the drive disc and driven disc in accordance with the teachings of the present invention.

FIG. 6 shows the impeller 82 formed of the discs of the present invention. Impeller 54 is used in place of the impeller shown in FIGS. 1-3 of the prior art. In FIG. 6, disc 50 is illustrated as connected by posts 70 to another disc 84. This "another disc" 84 will be the driven disc. As such, it can be seen that the post 70 joins the drive disc 50 to the driven disc 84. If additional driven discs are required by the material to be conveyed by the disc pump of the present invention, then posts 70 can extend outwardly on the opposite side 86 of driven disc 84 so as to join with additional driven discs. Driven disc 84 will have a similar configuration to that the disc 50 shown in FIGS. 4 and 5. However, the face 88 of driven disc 84 will face drive disc 50.

Figure 7:
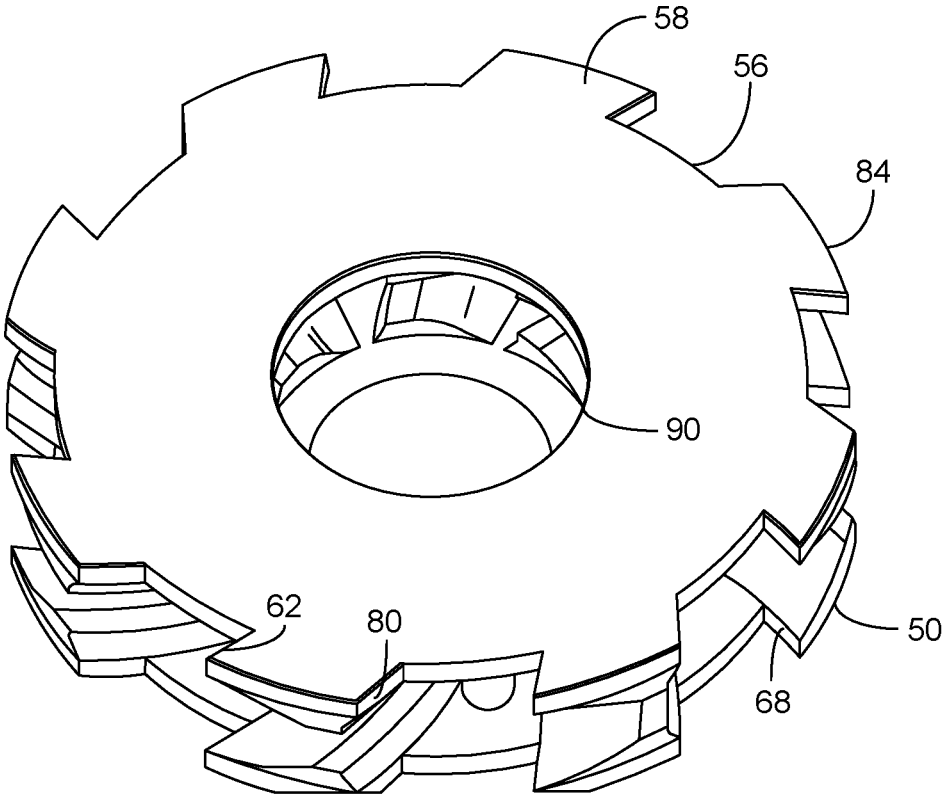
FIG. 7 is an upper perspective view showing the impeller having the drive disc and driven disc in accordance with the present invention.

FIG. 7 is another view showing the configuration of disc 50 and disc 84. In particular, it can be seen that the portions 58 that extends outwardly of the outer diameter 56 of the discs 50 and 84 include a jagged edge 68. Furthermore, FIG. 7 shows that the thickness of the portion 58 will be minimal at side 62 and greatest at side 80. Driven disc 84 includes a hole 90 at the center thereof so as to allow fluids to pass therethrough.

The disc pump of the present invention includes design improvements associated with the discs 50 and 84 so as to increase the efficiency of the disc pump. In particular, the vanes on the discs 50 and 84 have wing vanes 54 which extend beyond the outer diameter 56 so as to effectively propel the fluid. The wing vane 54 minimizes eddy currents on the back of the vane 54. Eddy currents create swirls and spaces devoid of downstream flowing liquid. These are dead zones for the next propelling vane or rib. On the wing vane of the present invention, the Coanda effect will help the liquid cling to the surface of the wing and minimize the dead zones and swirls. By increasing the diameter of the wing vane 54 beyond the outer diameter 56 of the disc 50 and/or disc 84 will increase the surface area of the propelling device. A typical rounded outer diameter disc does very little to propel the liquid. The serrated design of the present invention induces the centrifugal force and essentially increases the propelling surface area. Because of this greater surface area, more force/energy is transferred to the liquid. The impeller 82 of the present invention allows the present invention to pump liquids with slurries, solids, high-viscosity liquids, and liquids entrained with air or gases. The present invention, because of the efficiency thereof, makes the impeller more competitive and reduces the operating carbon footprint.

In the present invention, the discs 50 and 84 are joined together specifically by four posts that are located approximately halfway between the inner diameter and the outer diameter of the disc. The drive disc has an outer diameter that can range between six inches and twenty inches. The driven disc will have an inner diameter of the hole 90 ranges between 2 inches and 8 inches. The outer diameters will be identical for both the drive disc 50 and the driven disc 84.

Figure 8:
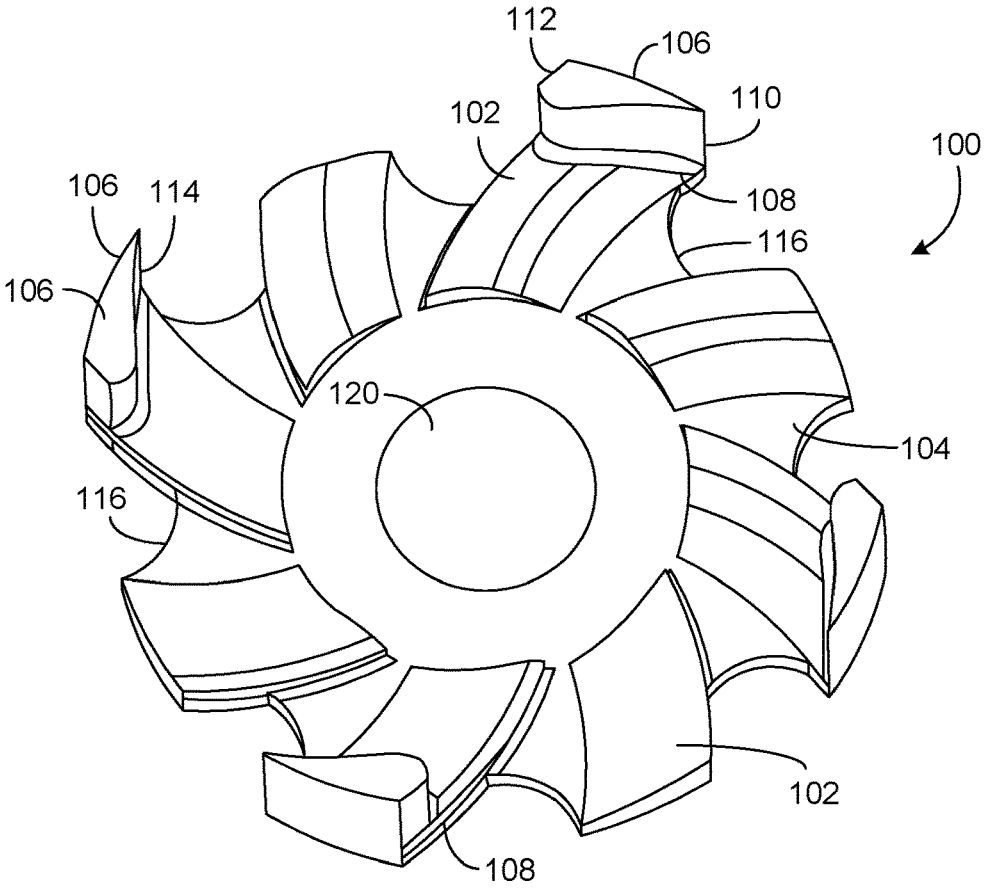
FIG. 8 is an isolated upper perspective view of an alternative embodiment of the present invention having winglets extending from the plurality of wing vanes.

FIG. 8 shows an alternative embodiment of disc 100 of the present invention. Disc 100 can be employed in a similar manner to that described hereinabove. In particular, disc 100 includes wing vanes 102 that project outwardly beyond the outer diameter of the face 104 of disc 100. In the embodiment shown in FIG. 8, disc 100 can either be the drive disc or the driven disc. Specifically, in FIG. 8, the drive disc is illustrated by disc 100. Each of the wing vanes 102 will have a similar configuration to that of the wing vanes of the previous embodiment, except for the addition of a winglet 106 located at the outwardly extending portion 108 of the wing vanes 102. Winglet 106 extends in generally transverse relationship to the wing vane 102. The winglet 106 will have an airfoil shape with a narrow thickness at side 110 and a wide thickness at side 112. The airfoil shape has a curved inner surface 114 and a curved outer surface 116. FIG. 8 shows that the disc 100 has a scalloped shape. In particular, scallops 116 are located between adjacent pairs of the wing vanes 102. FIG. 8 shows that disc 100 is actually a drive disc because of the location of the connector 120 centrally of the face of the disc 100. The wing vanes 102 radiate outwardly from the connector 120.

Figure 9:
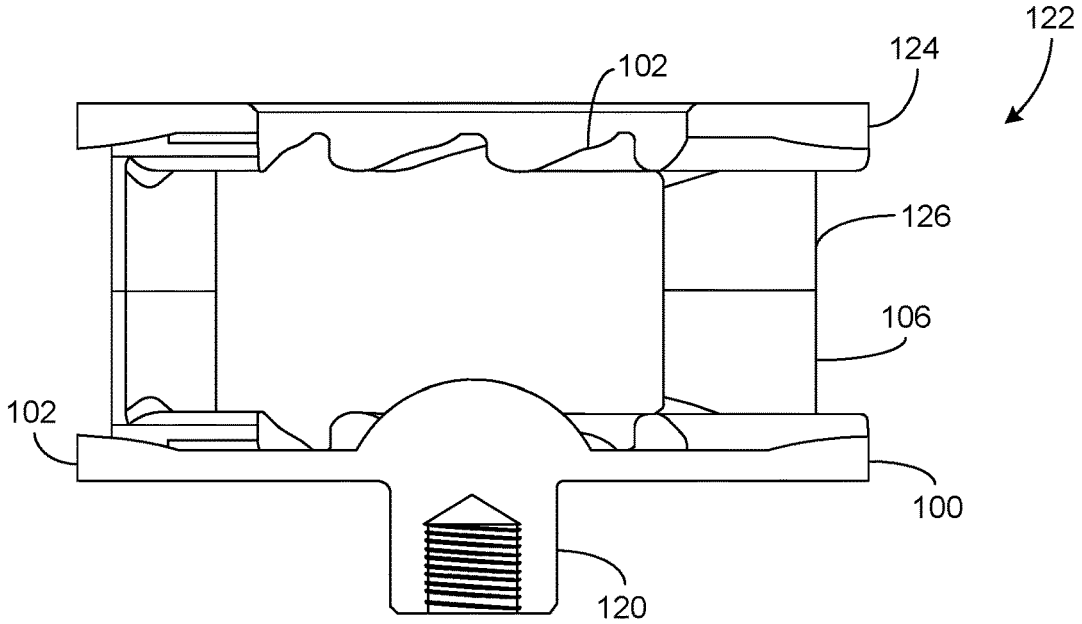
FIG. 9 is a side elevational view showing the impeller in accordance with the alternative embodiment of FIG. 8.

FIG. 9 shows the assembled configuration of the impeller 122 of this alternative embodiment of the present invention. In particular, it can be seen that the disc 100 is the drive disc because of the connector 120. Connector 120 connects disc 100 to the shaft of a pump or motor. The wing vanes 102 radiate outwardly from the connector 120. The winglets 106 project upwardly from the end of the wing vanes 102.

In FIG. 9, the driven disc 124 has wing vanes 102 formed thereon. The winglets 126 of driven disc 124 extend downwardly from the wing vanes 102 so as to be affixed to the winglets 106 of drive disc 100.

Figure 10:
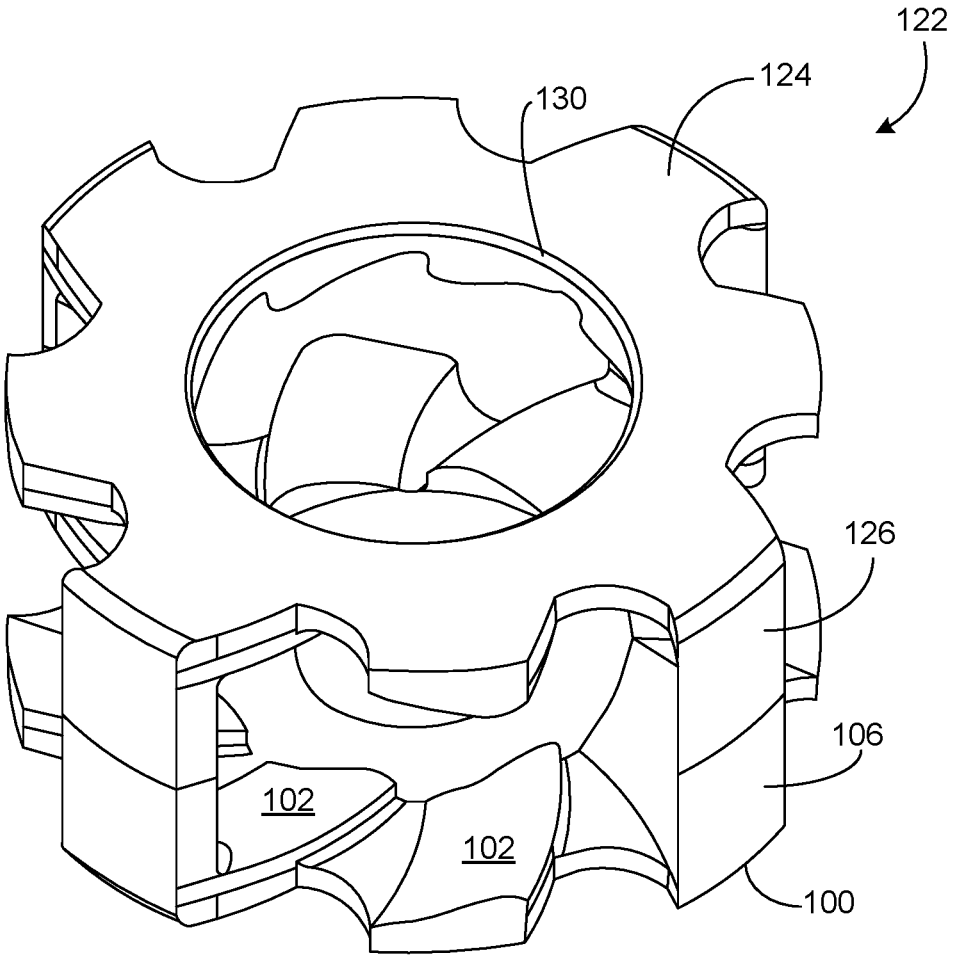
FIG. 10 is an upper perspective view showing the impeller in accordance with the teachings of this alternative embodiment of the present invention.

FIG. 10 shows the configuration of the impeller 122 in accordance with this alternative embodiment of the present invention. In particular, it can be seen that the driven disc 124 is joined to the drive disc 100 by the respective winglets 106 and 126. Wing vanes 102 support the winglets 106 and 122 for both the drive disc 100 and the driven disc 124. Hole 130 is formed centrally of the driven disc 124 so as to allow fluids to pass therethrough. In particular, there are four winglets 106 for each of the discs 100 and 124. As such, in this preferred embodiment, four of the wing vanes 102 will support the winglets while other wing vanes 102 are free of the winglets 106. The winglets 106 will alternate between the wing vanes 102 in the manner shown in FIG. 10.

The wing vanes on the discs at the front end can have a thickness of between ¼ inch to ¾ inch. The winglet will have a front end profile which is mostly curved. However, within the concept of the present invention, it can be rectangular and can taper so as to avoid vortices. The same applies to the wing vanes. The jagged outwardly extending edges on the wing vanes on the periphery of the disc will stick out no more than 20% of the total outer diameter of the disc.

The winglet serves to further increase the efficiency of the disc. This can further impart energy to the liquid at the highest centrifugal speed and near the cut water of the volute. The winglets can also serve to attach the disc together in the nature of the posts of the previous embodiment. The angle of attack of the wing vanes can vary according to the medium being pumped. The size and geometric shape of the winglet can also vary according to the medium being pumped.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An impeller for a disc pump, the impeller comprising:

a drive disc having a connector for joining to a shaft of the disc pump;

a driven disc affixed to said drive disc so as to define a space therebetween, said drive disc having a face facing a face of said driven disc, said drive disc extending in generally parallel planar relationship to said driven disc; and a plurality of wing vanes formed on the face of at least one of said drive disc and said driven disc, said plurality of wing vanes radiating across the face of the at least one of said drive disc and said driven disc and toward an outer diameter of the at least one of said drive disc and said driven disc, said plurality of wing vanes having a portion extending outwardly beyond the outer diameter of the at least one of said drive disc and said driven disc.

2. The impeller of claim 1, each of said plurality of wing vanes having a thickness that tapers so as to narrow across a width of each of said plurality of wing vanes.

3. The impeller of claim 2, the thickness of each of said plurality of wing vanes being flush with the face of the at least one of said drive disc and said driven disc at one side of each of said plurality of wing vanes.

4. The impeller of claim 1, a surface of each of said plurality of wing vanes opposite the face of the at least one of said drive disc and said driven disc having a curved shape such that one end of the curved shape is flush with the face of the at least one of said drive disc and said driven disc, the end of the curved shape being spaced from the face of the at least one of said drive disc and said driven disc.

5. The impeller of claim 4, wherein the surface of each of said plurality of wing vanes is at a forward drive direction of the at least one of said drive disc and said driven disc.

6. The impeller of claim 1, the portion of each of said plurality of wing vanes that extends outwardly beyond the outer diameter of the at least one of said drive disc and said driven disc extends outwardly for no more than 20% of the outer diameter of the at least one of said drive disc and said driven disc.

7. The impeller of claim 1, the portion of each of said plurality of wing vanes that extends outwardly beyond the outer diameter of the at least one of said drive disc and said driven disc having a jagged edge.

8. The impeller of claim 1, said drive disc being affixed to said driven disc by a plurality of posts extending transverse to the respective faces of said drive disc and said driven disc.

9. The impeller of claim 8, said plurality of posts each arranged between adjacent pairs of said plurality of wing vanes.

10. The impeller of claim 9, each of said plurality of posts having a circular cross-section in a plane parallel to the face of the at least one of said drive disc and said driven disc.

11. The impeller of claim 1, said plurality of wing vanes being formed on both of said drive disc and said driven disc.

12. The impeller of claim 11, said plurality of wing vanes on one of said drive disc and said driven disc corresponding in location to said plurality of wing vanes on the other of said drive disc and said driven disc.

13. The impeller of claim 1, each of said plurality of wing vanes having a forward edge, the forward edge having an arcuate shape.

* * * * *